United States Patent [19]

Deibele

[11] 4,391,461

[45] Jul. 5, 1983

[54] QUARTER-TURN FASTENER

[75] Inventor: Florian C. Deibele, Tigard, Oreg.

[73] Assignee: Tektronix, Inc., Beaverton, Oreg.

[21] Appl. No.: 197,438

[22] Filed: Oct. 16, 1980

[51] Int. Cl.[3] ..... E05C 3/12

[52] U.S. Cl. ..... 292/204; 292/DIG. 38

[58] Field of Search ..... 292/204, 53, 202, 209, 292/107, 241, 353, DIG. 7, DIG. 38

[56] References Cited

U.S. PATENT DOCUMENTS

| | | | |
|---|---|---|---|
| 319,887 | 6/1885 | Crump | 292/209 |
| 1,381,083 | 6/1921 | Crawford | 292/209 |
| 2,900,678 | 8/1959 | Curtis | 292/202 X |
| 3,121,383 | 2/1964 | Parrish | 98/114 |
| 3,123,389 | 3/1964 | Biesecker | 292/241 X |
| 3,161,427 | 12/1964 | Anders | 292/194 |
| 3,466,075 | 9/1969 | Fernandez et al. | 292/DIG. 38 |
| 3,575,452 | 4/1971 | Blomgren | 292/202 |
| 4,153,284 | 5/1979 | Wright | 292/202 |
| 4,179,144 | 12/1979 | Henderson | 292/202 |
| 4,186,952 | 2/1980 | Glass | 292/DIG. 53 X |

*Primary Examiner*—Richard E. Moore

*Attorney, Agent, or Firm*—George T. Noe

[57] ABSTRACT

A one-piece molded plastic quarter-turn fastener is provided for releasably latching a panel to a cabinet. A generally disc-like body has a flanged and slotted stem axially extending therefrom to be snapped into a hole in the panel. Projecting radially from the body is a latching lip for engaging and disengaging a cabinet. A positioning boss is provided to permit a quarter-turn rotation of the fastener with a detent provided at each rotational limit.

5 Claims, 5 Drawing Figures

QUARTER-TURN FASTENER

BACKGROUND OF THE INVENTION

The present invention relates to closure fasteners in general, and in particular to a one-piece quarter-turn fastener for releasably latching a panel to a cabinet.

Cabinets, such as those for housing electronic instruments, commonly have panels which may be removed to provide access to the interior. Typically, such panels are releasably latched to the cabinet by means of one or more pawl-type quarter-turn fasteners. This type of fastener has a pawl, or latching arm, which is rotatable into engagement with a cabinet flange to capture the cabinet flange between the pawl and panel in a latching position, and rotatable ninety degrees to an unlatching position, releasing the cabinet flange to thereby permit the panel to be removed from the cabinet. Such quarter-turn fasteners have heretofore been constructed of two or more metal parts, and have required a substantial assembly and mounting procedure to attach them to the panel.

SUMMARY OF THE INVENTION

In accordance with the present invention, a one-piece molded plastic quarter-turn fastener is provided for releasably latching a panel to a cabinet. The fastener is in the form of a generally disc-like body having a flanged and slotted stem portion axially extending through a hole in the cabinet to serve as both a retainer and a means for rotating the fastener. As such, the fastener may be mounted on the panel by simply snapping it into the hole provided in the panel. Integrally molded with the disc and projecting radially from the periphery of such disc are a latching lip and a positioning boss. The lip engages or disengages the cabinet flange to perform the fastening function as the fastener is turned in the panel hole. The boss travels between two deep dimples or holes ninety degrees apart to provide two rotational positions.

It is therefore one object of the present invention to provide a one-piece quarter-turn fastener for releasably latching a panel to a cabinet.

It is another object of the present invention to provide a quarter-turn fastener that is one piece and is molded of plastic.

It is a further object of the present invention to provide a quarter-turn fastener that is simple in construction and inexpensive.

It is an additional object of the present invention to provide a quarter-turn fastener which may be rotatably mounted to a panel by snapping it into a hole provided therefor.

Other objects and attainments of the present invention will become obvious to those having ordinary skill in the art upon a reading of the following description when taken in conjunction with the accompanying drawings.

DRAWINGS

DETAILED DESCRIPTION OF THE INVENTION

Figure 1:
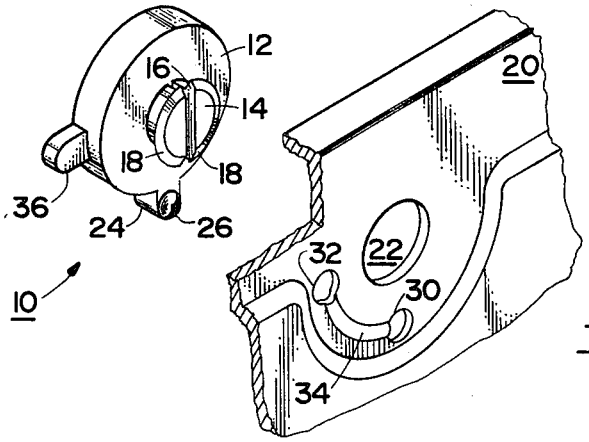
FIG. 1 is an exploded perspective view of a quarter-turn fastener in accordance with the present invention.

Several views of the preferred and an alternative embodiment are shown in the drawings, and therefore the same reference numerals will be used to indicate the same parts in the views. Referring now to FIG. 1, there is shown a fastener 10 comprising a disc-like body 12 having a stem 14 extending axially therefrom. The stem 14 has a slot 16 therein to permit rotation of the fastener 10 by means of a screwdriver or a coin inserted into the slot. The stem 14 also has a shouldered portion or flange 18 extending radially therefrom on each side of the slot to serve as a retainer for holding the fastener in place once installed in a panel 20. The panel has a hole 22 therethrough, the diameter of which is slightly larger than the diameter of the stem 14 at its narrow portion between the body 12 and the flanges 18 to permit free rotation of the fastener 10. Of course, the diameter of hole 22 is smaller than the outside diameter of the flanges 18. The fastener 10 is snapped into the panel 20 by inserting the stem 14 into the hole 22 and applying slight pressure. The slot 16 permits the two sides of stem 14 to flex inwardly as the flanges 18 pass through the hole 22, then snap back so that the flanges 18 retain the fastener in position.

Molded on the periphery of disc-like body 12 and forming an integral part thereof is a projection 24 having a hemispherical detent boss 26 extending slightly forward of the face of the disc 12. The detent boss 26 snaps into one of two deep dimples or holes 30 or 32 located ninety degrees apart in the panel 20 to lock the fastener 10 in one of two rotational positions. When the fastener is rotated to its other position, the detent boss 26 rides up out of the dimple or hole 30 or 32 and describes an arc across the surface of the panel 20 until it snaps into the other dimple or hole. A grooved semicircular track 34 may be provided on the inner surface of panel 20 to facilitate movement of the detent boss 26 between dimples or holes 30 and 32 while restricting rotational travel beyond those limits.

Also molded on the periphery of disc-like body 12 and forming an integral part thereof is an outwardly projecting lip 36 for engaging and disengaging a flange on a cabinet to perform the fastening function as fastener 10 is turned in the hole 22, as will be described below.

Figure 4:
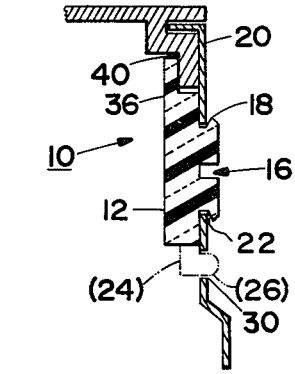
FIG. 4 is a sectional view taken along the line 4–4′ of FIG. 3.
Figure 3:
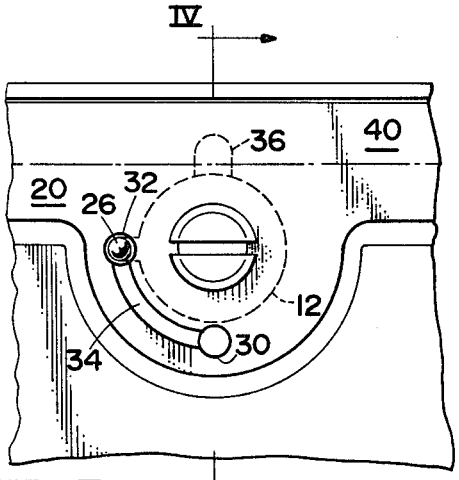
FIG. 3 is a front elevation view of a portion of a panel which incorporates the fastener of the present invention shown in a latched position.
Figure 2:
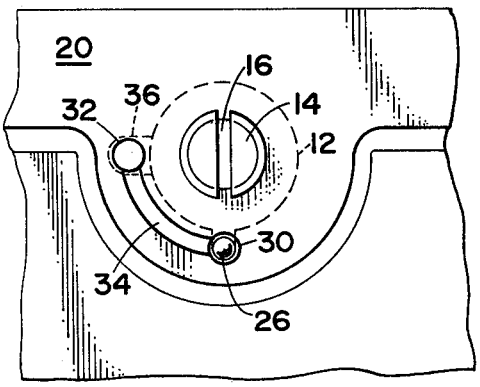
FIG. 2 is a front elevation view of a portion of a panel which incorporates the fastener of the present invention shown in an unlatched position.

In FIG. 2, a front elevation view of a portion of panel 20 is shown incorporating the fastener in an unlatched position, wherein the portions of the fastener which are behind the panel are shown by dashed lines. Here, the detent boss 26 is located in hole 30 and the radially extending lip 36 is located in an unlatched position behind the hole 32. In FIG. 3, which is a front elevation view similar to that of FIG. 2, the detent boss 26 is located in hole 32 and the lip 36 is located in a latched position behind a cabinet flange 40. This latched position may be seen more clearly with reference to FIG. 4. When the fastener 10 is rotated ninety degrees clockwise to the latched position, the lip 36 frictionally engages the flange 40 of a cabinet to capture the flange 40 between the lip 36 and the panel 20. When the fastener 10 is rotated counterclockwise ninety degrees to the unlatched position, the lip 36 releases the flange 40, and the cover 20 may be removed. In the unlatched position, boss 26 (shown in phantom) locks into hole 30.

In a practical embodiment, the present invention may be a single fastener in an access panel or, may be one of several fasteners in a cabinet panel of the type found in electronic equipment. These panels may be either sheet metal or plastic; however, panel 20 is shown in the drawings as metal.

The fastener 10 may be a suitable plastic material, and may be molded as a single integral part using any conventional molding or casting techniques.

Figure 5:
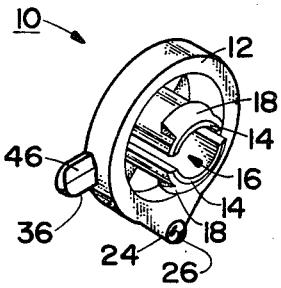
FIG. 5 is a perspective view of an alternative embodiment.

An alternative embodiment is shown in FIG. 5. Here, the fastener 10 is designed to be extremely light in weight, and utilizing a minimum of material while providing the desired structural strength. The stem halves 14 extend from a cavity in the body 12, and the greater length provided thereby permits greater flexibility, and hence, easier installation into a panel. The lip 36 has a bevelled surface 46 to facilitate engagement with a cabinet flange when the fastener is rotated to a latched position.

It is to be expressly understood that the present invention is not limited to the embodiment illustrated and described herein. Various changes can be made in the design and arrangement of parts without departing from the spirit and scope of the invention as will now be understood by those skilled in the art.

What I claim as being novel is:

1. A fastener for releasably latching a panel to a cabinet, comprising:

a generally disc-like one-piece body;

means integrally formed with said body for rotatably mounting said body to said panel;

a lip integrally formed with said body and extending radially therefrom, said lip being rotatable into latching engagement with said cabinet; and a positioning boss integrally formed with said body, said positioning boss comprising a projection engagable with a detent in said panel for establishing a stable position of said fastener.

2. A fastener in accordance with claim 1 wherein said means for rotatably mounting said body to said panel comprises a stem extending axially from said body and having means thereon for retaining said fastener in said panel.

3. A fastener in accordance with claim 2 wherein said stem has a longitudinal slot and said retaining means comprise radially extending flanges contraposed on opposite sides of said slot.

4. A fastener in accordance with claim 3 wherein said stem extends from a cavity formed in said body.

5. A fastener in accordance with claim 1 wherein said body, mounting means, and lip comprise a unitary structure molded of plastic.

* * * * *